US009814325B1

(12) United States Patent
Mendre

(10) Patent No.: US 9,814,325 B1
(45) Date of Patent: Nov. 14, 2017

(54) ILLUMINATED BOTTLE RACK

(71) Applicant: Robert Mendre, Tigard, OR (US)

(72) Inventor: Robert Mendre, Tigard, OR (US)

( * ) Notice: Subject to any disclaimer, the term of this patent is extended or adjusted under 35 U.S.C. 154(b) by 274 days.

(21) Appl. No.: 14/823,064

(22) Filed: Aug. 11, 2015

(51) Int. Cl.

| | |
|---|---|
| ***F21V 21/00*** | (2006.01) |
| ***A47F 3/00*** | (2006.01) |
| ***A47F 7/00*** | (2006.01) |
| ***A47F 7/28*** | (2006.01) |
| ***F21S 4/00*** | (2016.01) |
| ***F21V 23/00*** | (2015.01) |
| ***F21V 23/06*** | (2006.01) |
| ***F21V 23/04*** | (2006.01) |
| *F21Y 113/00* | (2016.01) |
| *F21Y 101/02* | (2006.01) |

(52) U.S. Cl.
CPC ..... *A47F 3/001* (2013.01); *A47F 7/0007* (2013.01); *A47F 7/0071* (2013.01); *A47F 7/28* (2013.01); *F21S 4/003* (2013.01); *F21V 23/001* (2013.01); *F21V 23/003* (2013.01); *F21V 23/04* (2013.01); *F21V 23/06* (2013.01); *F21Y 2101/02* (2013.01); *F21Y 2113/005* (2013.01)

(58) Field of Classification Search
CPC ... F21Y 2113/005; F21Y 2101/02; F21S 4/00; F21S 4/20; F21S 4/28; A47F 3/001; A47F 7/007; A47F 7/0071; A47F 7/28; F21V 23/001; F21V 23/003; F21V 23/06; F21V 23/08
See application file for complete search history.

(56) References Cited

U.S. PATENT DOCUMENTS

| | | | | |
|---|---|---|---|---|
| 5,205,638 | A | 4/1993 | Squitieri | |
| 5,690,415 | A * | 11/1997 | Krehl | A47F 5/101 108/23 |
| 6,578,978 | B1 * | 6/2003 | Upton | A47F 3/001 362/125 |
| 7,121,675 | B2 * | 10/2006 | Ter-Hovhannisian | A47F 3/001 362/92 |
| 7,513,637 | B2 * | 4/2009 | Kelly | A47F 3/001 362/125 |
| 7,824,056 | B2 | 11/2010 | Madireddi | |
| D647,246 | S | 10/2011 | Chadwick | |
| 8,070,305 | B2 * | 12/2011 | Bratton | A47F 3/001 362/217.05 |
| D670,316 | S | 11/2012 | Grutzke | |
| 8,463,430 | B2 | 6/2013 | Segal | |
| 8,525,999 | B2 * | 9/2013 | Brukilacchio | A61B 1/0653 356/432 |

(Continued)

FOREIGN PATENT DOCUMENTS

FR 2903876 1/2008

*Primary Examiner* — Ali Alavi
(74) *Attorney, Agent, or Firm* — Kyle A. Fletcher, Esq.

(57) ABSTRACT

The illuminated bottle rack is an accessory adapted for use with a beverage display. The accessory includes an LED strip that is adapted to attach itself onto a beverage display shelf. Moreover, the LED strip is secured onto the beverage display shelf via at least one bracket. The LED strip is adapted to be presented underneath the beverage display shelf so as to illuminate at least one bottle positioned on the beverage display shelf. The LED strip is wired to a first controller, which in turn includes a wire that is adapted to be inserted into a standard electrical outlet. A remote controller may be included to remotely control the output of the LED strip.

12 Claims, 5 Drawing Sheets

(56) References Cited

U.S. PATENT DOCUMENTS

| | | | | |
|---|---|---|---|---|
| 9,456,704 | B2 * | 10/2016 | Bhargava | A47F 3/001 |
| 9,691,308 | B2 * | 6/2017 | Meyer | A47F 5/0068 |
| 2005/0265019 | A1 * | 12/2005 | Sommers | A47F 3/001<br>362/217.16 |
| 2009/0080178 | A1 | 3/2009 | Wilsdorf | |
| 2009/0219720 | A1 * | 9/2009 | Reed | A47F 3/001<br>362/308 |
| 2009/0308286 | A1 * | 12/2009 | Bourbeau | A47B 96/00<br>108/23 |
| 2010/0188018 | A1 * | 7/2010 | Salm | F21V 7/00<br>315/294 |
| 2011/0204009 | A1 * | 8/2011 | Karan | A47F 1/12<br>211/59.2 |
| 2013/0188356 | A1 | 7/2013 | Breslow | |
| 2013/0229789 | A1 | 9/2013 | Yoshida | |
| 2016/0047539 | A1 * | 2/2016 | Cano | F21V 33/0012<br>362/133 |

* cited by examiner

ILLUMINATED BOTTLE RACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of beverage displays, more specifically, a bottle rack that displays a plurality of bottles thereon, and which is further illuminated.

Beverage displays provide a pivotal role in the retail world. Most stores include at least one beverage display, which is usually refrigerated in order to keep the contents chilled. Some beverage displays include glass doors so as to see the beverages being stored therein. However, the interior of the beverage display may be unlit or poorly lit.

What is needed, and what is accomplished via the device of the present application is an accessory that is adapted to be installed into an existing beverage display in order to illuminate the beverages or bottles being stored and displayed therein.

SUMMARY OF INVENTION

The illuminated bottle rack is an accessory adapted for use with a beverage display. The accessory includes an LED strip that is adapted to attach itself onto a beverage display shelf. Moreover, the LED strip is secured onto the beverage display shelf via at least one bracket. The LED strip is adapted to be presented underneath the beverage display shelf so as to illuminate at least one bottle positioned on the beverage display shelf. The LED strip is wired to a first controller, which in turn includes a wire that is adapted to be inserted into a standard electrical outlet. A remote controller may be included to remotely control the output of the LED strip.

It is an object of the invention to provide a device that is able to attach onto a beverage display shelf in order to illuminate the contents of the beverage display shelf.

It is a further object of the invention to include a remote control that enables wireless operation of the accessory.

These together with additional objects, features and advantages of the illuminated bottle rack will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated bottle rack in detail, it is to be understood that the illuminated bottle rack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated bottle rack.

It is therefore important that the claims be regarded as including such equivalent construction insofar as they do not depart from the spirit and scope of the illuminated bottle rack. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
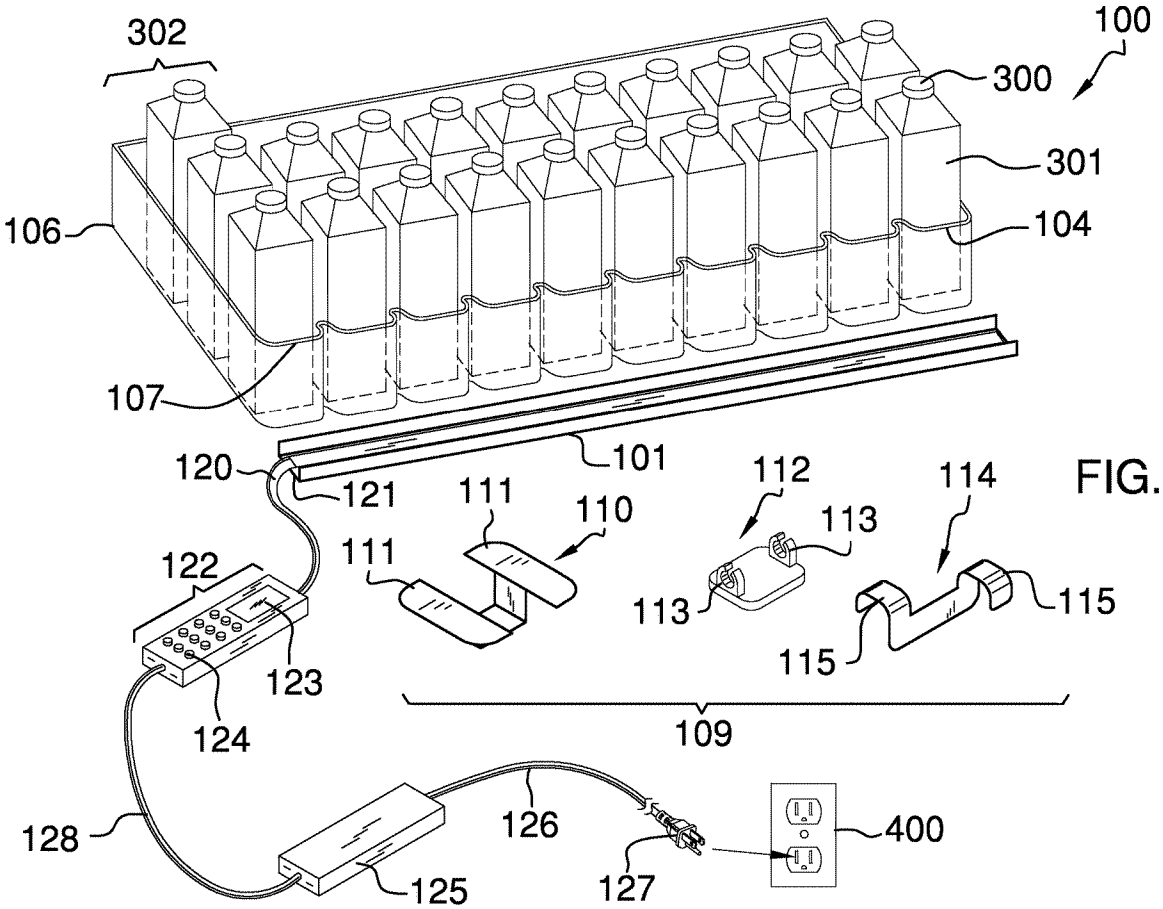
FIG. 1 is a perspective view of an embodiment of the disclosure.
Figure 2:
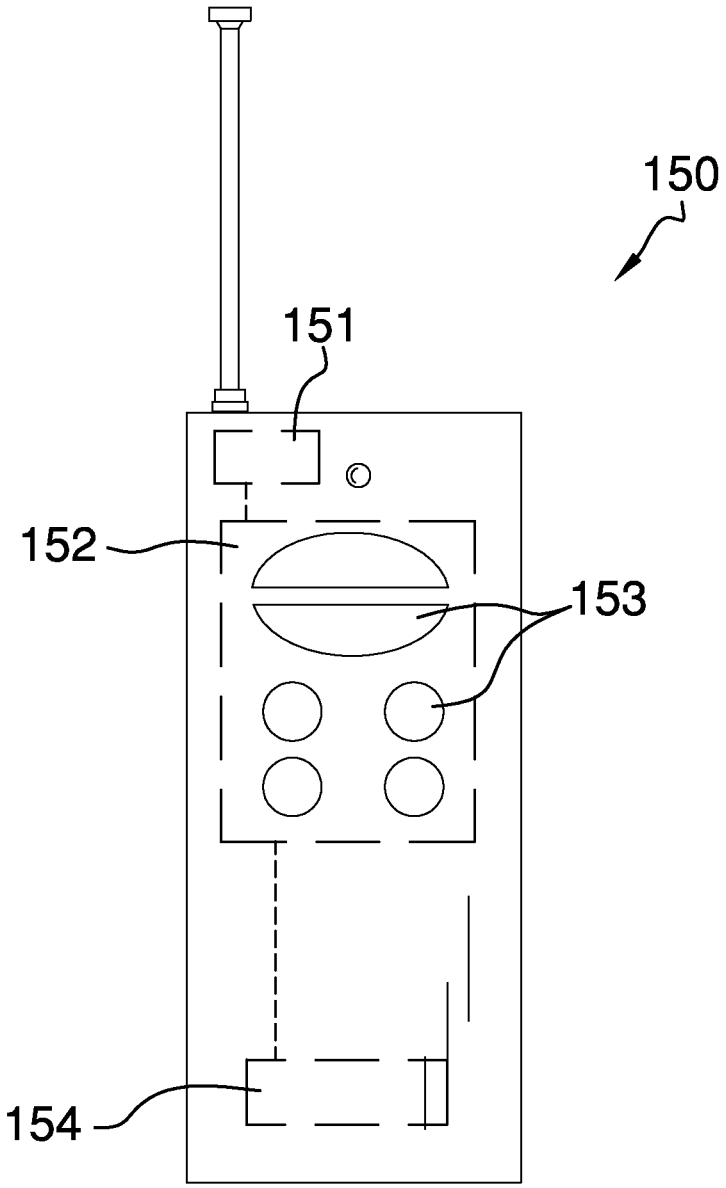
FIG. 2 is a front view of a remote control of an embodiment of the disclosure.
Figure 3:
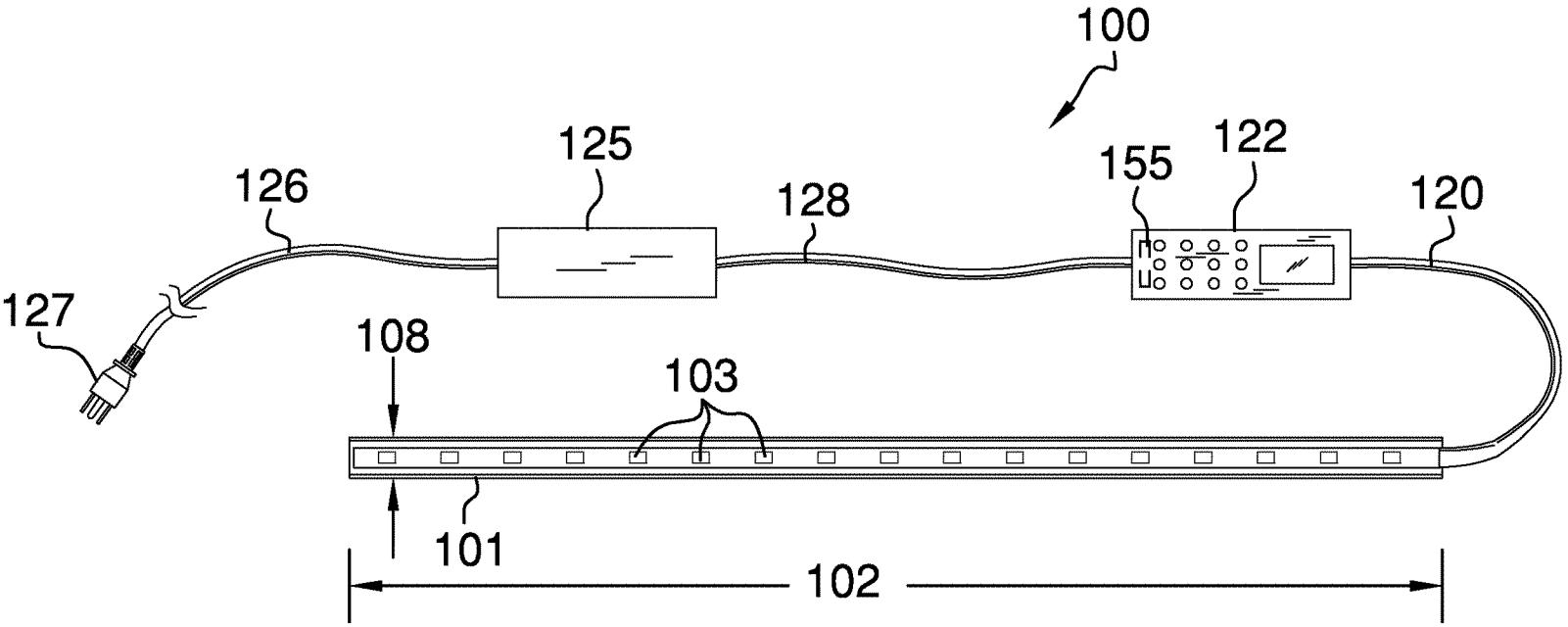
FIG. 3 is a top view of an embodiment of the disclosure.
Figure 4:
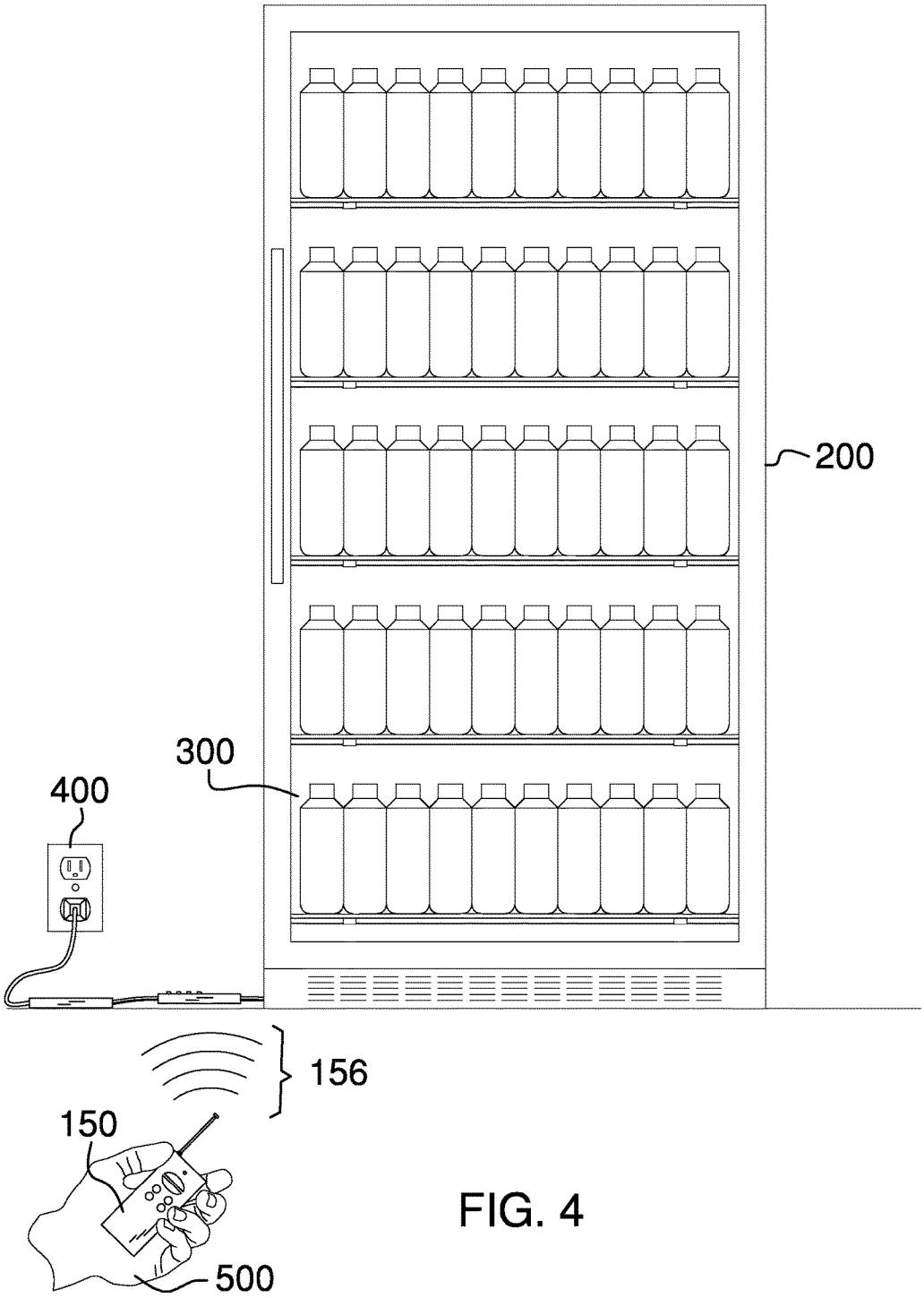
FIG. 4 is a view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 5. The illuminated bottle rack 100 (hereinafter invention) comprises an LED strip 101 that has a strip length 102. The strip length 102 shall be equal or less than a shelf length 201 of a beverage display shelf 202 of a beverage display 200.

The LED strip 101 includes a plurality of LEDs 103 that are equally spaced along the strip length 102. The plurality of LEDs 103 may be the same color or vary in color. The LED strip 101 is further defined with a "C"-channel cross section 104. The "C"-channel cross section 104 includes a center portion 105 onto which the plurality of LEDs 103 is provided. The LED strip 101 may be made of a plastic, metal, carbon fiber composite, ceramic, wood. Moreover, the LED strip 101 may be further defined with a strip width 108. The strip width 108 shall not be greater than 2 inches.

The invention 100 is used to illuminate at least one bottle 300. Moreover, the term bottle 300 is being used to refer to a container or other object that stores a beverage. The invention 100 may include a beverage organizer 106. The beverage organizer 106 is made of a translucent material, and able to organize a plurality of the bottles 300. Moreover, the beverage organizer 106 includes a plurality of forward indentations 107 that are customized to accommodate a front surface 301 of the at least one bottle 300. Moreover, the beverage organizer 106 enables rows 302 to be formed of the at least one bottle 300.

Figure 5:
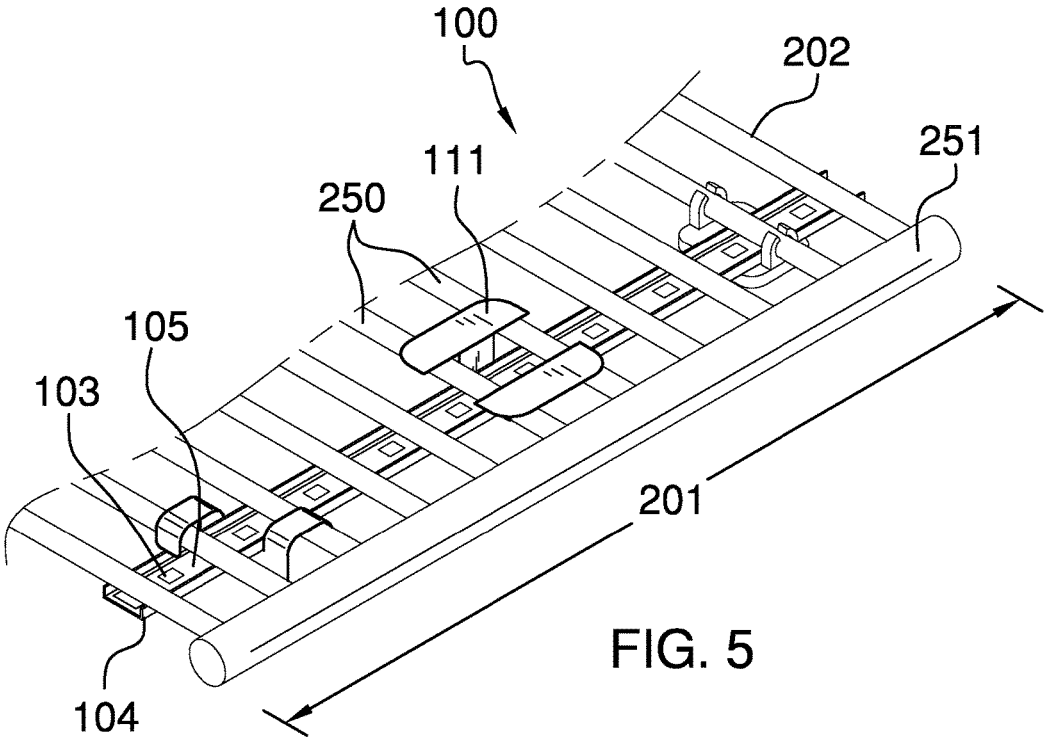
FIG. 5 is a perspective, detail view of an embodiment of the disclosure.

The invention 100 includes at least one holder clip 109 that is used to secure the LED strip 101 to the beverage display shelf 202. Moreover, the at least one holder clip 109 is used to secure the LED strip 101 underneath the beverage display shelf 202. Referring to FIG. 5, the at least one holder clip 109 is adapted to engage at least one longitudinal member 250 of the beverage display shelf 202. It shall be noted that the beverage display shelf 202 is constructed of a plurality of the at least one longitudinal member 250, and may be loosely referred to as wire shelving.

The LED strip 101 is adapted to be adjacent to and parallel with a lateral member 251 of the beverage display shelf 202. The LED strip 101 is adapted to illuminate the at least one bottle 300 from underneath the beverage display shelf 202 and the at least one bottle 300. Moreover, the LED strip 101 is adapted to extend along and adjacent the lateral member 251, and be equal to or less than the shelf length 201.

Referring to FIG. 1, the at least one holder clip 109 may come in a plurality of differing shapes. Moreover, a first clip 110 includes a first pair of armatures 111 that are adapted to extend across two successive ones of the at least one longitudinal member 250. The first pair of armatures 111 is parallel with one another, and mirror one another.

A second clip 112 includes at least one pair of opposing fingers 113 that are adapted to clip onto the at least one longitudinal member 250. A third clip 114 includes a pair of third armatures 115 that are opposing one another, but are parallel with one another. The pair of third armatures 115 of the third clip 114 are adapted to extend across two successive ones of the at least one longitudinal member 250.

The LED strip 101 is in electrical connection with a first wire 120. The first wire 120 extends from a first distal end 121 of the LED strip 101. The first wire 120 is of an undefined length, and is also wired to a first controller 122. The first controller 122 includes a first display 123 and a plurality of first buttons 124 that enable user input as to the timing, duration of use, intensity, color, or other visual effects that the LED strip 101 may produce.

The first controller 122 is also wired to an LED driver 125 via a second wire 128. The LED driver 125 is a fancy way of saying a transformer or electrical converter. The electricity supplied to the invention 100 is likely a standard electrical outlet 400, which is simply too high for use with the LED strip 101. The LED driver 125 converts and/or transforms the power or voltage to a current and voltage that is satisfactory for use with the plurality of LEDs 103. The LED driver 125 is wired to a third wire 126 that includes an electrical plug 127 on a distal end. The electrical plug 127 is adapted to be plugged into the standard electrical outlet 400.

The invention 100 includes a remote control 150. The remote control 150 provides a user 500 with a wireless control of the invention 100. Moreover, the remote control 150 communicates wirelessly to the first controller 122 via a transmitter 151. The remote control 150 includes a microprocessor 152, a plurality of control buttons 153, and a powering member 154. The powering member 154 is at least one battery, and supplies electricity for the sole use of the remote control 150. The first controller 122 includes a receiver 155 that is able to receive signals 156 from the transmitter 151 of the remote control 150.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An illuminated bottle rack comprising:

an LED strip that is adapted to illuminate at least one bottle within a beverage display;

wherein the LED strip that has a strip length; wherein the strip length is adapted to be equal to or less than a shelf length of a beverage display shelf within said beverage display;

wherein the LED strip includes a plurality of LEDs thereon;

wherein the plurality of LEDs is equally spaced along the strip length;

wherein the plurality of LEDs involve the same color or vary in color;

wherein the LED strip is further defined with a "C"-channel cross section; wherein the "C"-channel cross section includes a center portion onto which the plurality of LEDs is provided;

wherein at least one holder clip is adapted to be used to secure the LED strip to the beverage display shelf;

wherein the at least one holder clip is used to secure the LED strip underneath the beverage display shelf;

wherein the at least one holder clip is adapted to engage at least one longitudinal member of the beverage display shelf;

wherein the LED strip is adapted to be adjacent to and parallel with a lateral member of the beverage display shelf.

2. The illuminated bottle rack according to claim 1 wherein the LED strip is in electrical connection with a first wire; wherein the first wire extends from a first distal end of the LED strip; wherein the first wire is wired to a first controller.

3. The illuminated bottle rack according to claim 2 wherein the first controller includes a first display and a plurality of first buttons that enable user input as to the timing, duration of use, intensity, color, or other visual effects that the LED strip produces.

4. The illuminated bottle rack according to claim 3 wherein the first controller is also wired to an LED driver via a second wire; wherein the LED driver is wired to a third wire that includes an electrical plug on a distal end; wherein the electrical plug is adapted to be plugged into a standard electrical outlet.

5. The illuminated bottle rack according to claim 4 wherein a remote control is adapted to provide a user with a wireless control of the first controller; wherein the remote control communicates wirelessly to the first controller via a transmitter; wherein the remote control includes a microprocessor, a plurality of control buttons, and a powering member; wherein the powering member is at least one battery, and supplies electricity for the sole use of the remote control.

6. The illuminated bottle rack according to claim 5 wherein the first controller includes a receiver that is able to receive signals from the transmitter of the remote control.

7. The illuminated bottle rack according to claim 1 wherein the LED strip is further defined with a strip width; wherein the strip width is not greater than 2 inches.

8. The illuminated bottle rack according to claim 1 wherein a beverage organizer is included, and is made of a translucent material, and is adapted to organize a plurality of the at least one bottle simultaneously within said beverage display.

9. The illuminated bottle rack according to claim 8 wherein the beverage organizer includes a plurality of forward indentations that are customized to accommodate a front surface of the at least one bottle; wherein the beverage organizer enables rows to be formed of the at least one bottle.

10. The illuminated bottle rack according to claim 1 wherein the at least one holder clip is further defined with a first clip that includes a first pair of armatures that are adapted to extend across two successive ones of the at least one longitudinal member; wherein the first pair of armatures is parallel with one another, and mirror one another.

11. The illuminated bottle rack according to claim 1 wherein the at least one holder clip is further defined with a second clip that includes at least one pair of opposing fingers that are adapted to clip onto the at least one longitudinal member.

12. The illuminated bottle rack according to claim 1 wherein the at least one holder clip is further defined with a third clip includes a pair of third armatures that are opposing one another, but are parallel with one another; wherein the pair of third armatures of the third clip are adapted to extend across two successive ones of the at least one longitudinal member.

* * * * *